United States Patent [19]

Piccolo, Jr.

[11] 4,432,138

[45] Feb. 21, 1984

[54] CUTTING BLADE

[76] Inventor: Albert V. Piccolo, Jr., 70-25 Yellowstone Blvd., Forest Hills, N.Y. 11376

[21] Appl. No.: 385,084

[22] Filed: Jun. 4, 1982

[51] Int. Cl.[3] ..... B26B 29/00

[52] U.S. Cl. ..... 30/294; 30/DIG. 3; 30/DIG. 8

[58] Field of Search ..... 30/294, DIG. 8, DIG. 3

[56] References Cited

U.S. PATENT DOCUMENTS

| | | | |
|---|---|---|---|
| 252,930 | 1/1882 | De Caindry | 30/DIG. 3 |
| 719,906 | 2/1903 | Thompson | 30/DIG. 3 |
| 1,192,200 | 7/1916 | Howard | 30/294 |
| 1,362,322 | 12/1920 | Johnson | 30/DIG. 3 |
| 2,705,833 | 4/1955 | Grantz | 30/294 |
| 2,764,814 | 10/1956 | Jecker | 30/294 |
| 3,290,780 | 12/1966 | Oehlert | 30/294 |
| 3,972,117 | 8/1976 | Fogg | 30/294 |
| 3,975,822 | 8/1976 | Mabus | 30/294 |

FOREIGN PATENT DOCUMENTS

| | | | |
|---|---|---|---|
| 804916 | 5/1951 | Fed. Rep. of Germany | 30/294 |
| 2247 | of 1889 | United Kingdom | 30/DIG. 8 |

*Primary Examiner*—Frederick R. Schmidt
*Assistant Examiner*—J. T. Zatarga
*Attorney, Agent, or Firm*—Henry Sternberg

[57] ABSTRACT

A cutting blade for a hand-held cutter for cutting a cloth cover from a dampener roller without damaging any material under the cutter. The blade has an upwardly curved front bottom edge portion, a convexly curved front tip portion, and a concavely curved upwardly extending cutting edge portion.

3 Claims, 4 Drawing Figures

11
12
13
14
15
16
17
18
10
11a
20
26
27
28
29
30
31
32

CUTTING BLADE

This invention relates to cutting blades for hand-held cutters for cutting covers from rollers and to such cutters.

Printing plates are commonly kept clean by dampener rollers, which may be rubber-coated steel-core rollers covered by one or more layers of cloth coverings. The cloth coverings are cylindrically-shaped sleeves which carry water and fountain solution. These cloth coverings work in conjunction with the fountain solution to wipe off and repel ink from non-image areas on the printing plate surface, thus yielding clear impressions. These cloth coverings must be changed periodically. Heretofore, it has been the practice to cut the outer covering off a dampener roller by hand with a knife blade pressing downwardly into the outer covering. This sometimes resulted in undesirably cutting an inner covering or injuring the surface of the rubber coating on the roller, causing costly repairs or replacing under surfaces.

It is an object of the present invention, therefore, to provide a new and improved cutting blade for a hand-held cutter for cutting covers from rollers.

It is another object of the invention to provide a new and improved cutting blade for a hand-held cutter for cutting an outer cover from a roller without damaging an inner cover during the cutting operation.

In accordance with the invention, a cutting blade for a hand-held cutter for cutting a cover from a roller comprises a longitudinally extending bottom edge portion and an upwardly curved front bottom edge portion extending forwardly of the aforesaid longitudinally extending bottom edge portion. The blade includes a convexly curved front tip portion and a concavely curved upwardly extending cutting edge portion. The blade also includes a longitudinally extending rear portion adapted to be set in a handle.

For a better understanding of the present invention, together with other and further objects thereof, reference is made to the following description, taken in connection with the accompanying drawings, and its scope will be pointed out in the appended claims.

Referring now to the drawings.

Figures 1, 2, 3, 4:
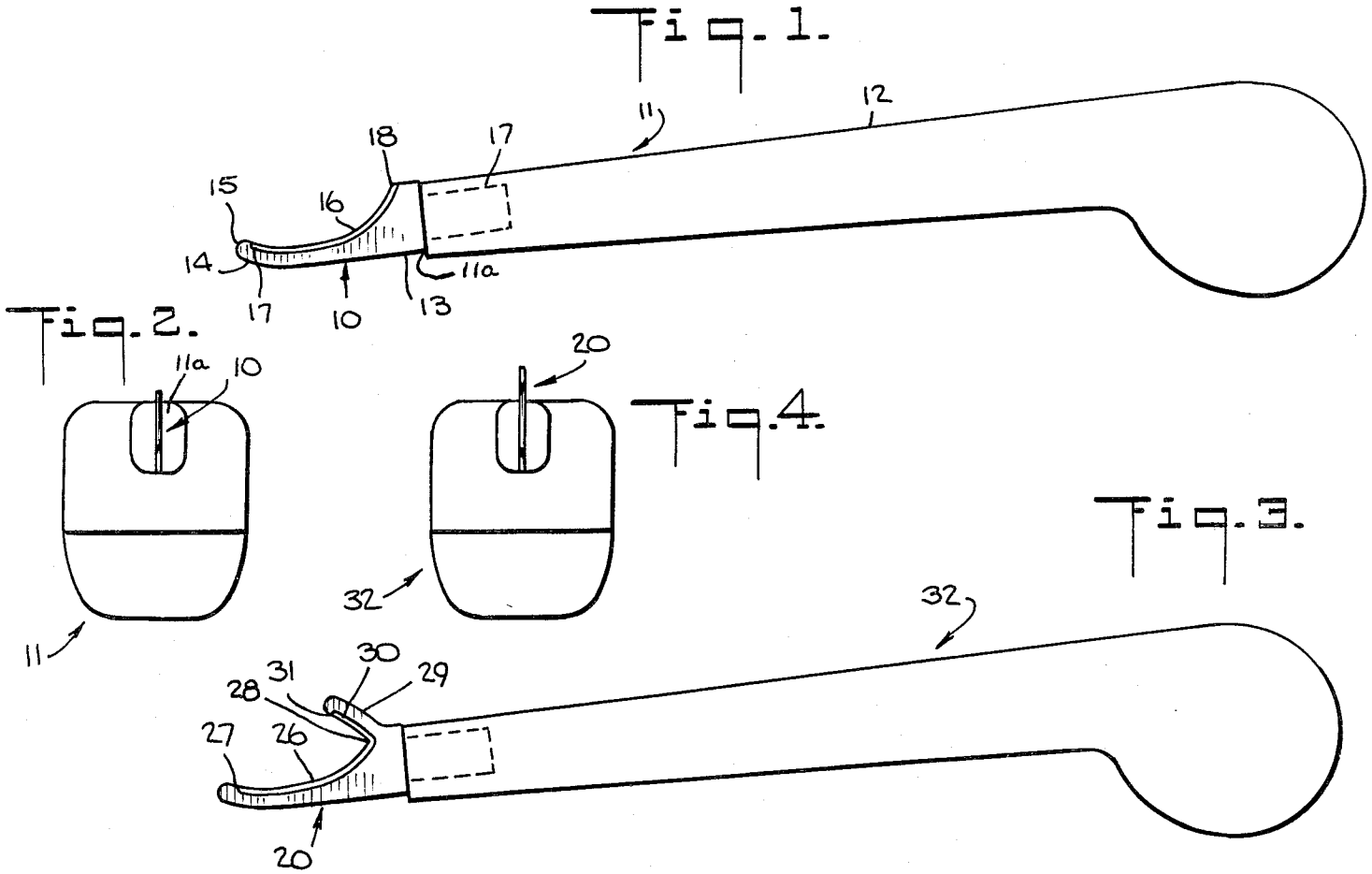
FIG. 1 is a side elevational view of a cutter including a preferred embodiment of a cutting blade constructed in accordance with the invention.
FIG. 2 is a front elevational view of the FIG. 1 cutter.
FIG. 3 is a side elevational view of a cutter including another cutting blade constructed in accordance with the invention.
FIG. 4 is a front elevational view of the FIG. 3 cutter.

Referring now more particularly to FIGS. 1 and 2 of the drawings, a cutting blade 10 for a hand-held cutter 11 having a handle 12 for cutting a cover from a roller preferably comprises a longitudinally extending flat bottom edge portion 13 and an upwardly curved front bottom edge portion 14 extending forwardly of the flat bottom edge portion 13. The blade includes a convexly curved front tip portion 15 and a concavely curved upwardly extending cutting edge portion 16 extending from point 17 to point 18.

The blade 10 includes a longitudinally extending rear portion 17 preferably adapted to be set in a tapered handle 11, which may, for example, be of suitable wood or plastic material, and having a front surface 11*a*. The blade 10 may, for example, be a sharpened steel blade having a maximum thickness at bottom edge portions 13, 14 and front tip portion 15 of 1/32 inch. The front tip portion 15 of the blade 10 has a height approximately one-quarter of the maximum height of the blade.

In using the FIG. 1 cutter, the front tip portion 15 of the blade 10 is placed under the cover to be cut, i.e. between the cover to be cut and the next adjacent inner surface whether it be an inner cover or the roller, and the blade is pushed forward along the length of the roller with the cutting edge 16 facing upwardly and lifting the cover being cut away from the roller. The cutter may held so that the blade 10 is at a slight angle with the point 18 of the blade moved upwardly. Since the cutting edge portion 16 faces upwardly, no damage is done to inner covers on the roller or to the surface of the roller while the blade cuts the outer cover. The cutting action is facilitated by the added tension of the material of the outer cover against the cutting edge as a result of the lifting of the cylindrical outer cover by the blade as the bottom edge of the blade glides along and is supported by the surface of the next adjacent inner cover or roller, as the case may be. The amount of such cutting tension may be controlled by the angle at which the user holds the blade with respect to the surface of the roller.

Referring now to FIGS. 3 and 4, the blade 20 there represented is similar to the blade 10 of the FIG. 1 embodiment except that the concave curvature of the cutting edge portion 26 extending from point 27 to point 28 is slightly less than the concave curvature of the cutting edge portion 16 of the blade 10 of FIG. 1 The blade 20 also includes an upper portion 29 extending forwardly from the upper region of the upwardly extending cutting edge portion 26 and having a downwardly extending cutting edge portion 30 which joins the upwardly extending cutting edge portion 26 at point 28. The downwardly extending cutting edge portion 30 is a concavely curved portion extending to point 31 and is of short length, preferably about $\frac{1}{3}$ the length of the upwardly extending cutting edge portion 26.

The handle 32 of the of the FIG. 3 cutter may be held at an angle similar to the handle 12 of the FIG. 1 cutter and the cutting blade 20 may be used in a manner similar to the cutting blade 10 of FIG. 1. In the event that there is any bunching of the cloth covering being cut, the cutting edge 31 cooperates with the cutting edge 26 to cut the bunched cloth.

While the blades shown are fixed in their respective handles, it is possible to have a handle with several interchangeable blades insertable therein.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A hand-held cutter for cutting a cover from a roller comprising:

a handle;

a cutting blade having a longitudinally extending bottom edge portion, an upwardly curved front bottom edge portion extending forwardly of said longitudinally extending bottom edge portion, a convexly curved front tip portion, a concavely curved upwardly extending cutting edge portion, and a longitudinally extending rear portion set in said handle, said cutting blade including an upper portion extending forwardly and upwardly from the upper region of said upwardly extending cutting edge portion and having a downwardly extending concavely curved cutting edge portion which joins said upwardly extending cutting edge portion and which extends upwardly from the uppermost region of said longitudinally extending rear portion a distance equal to approximately one-third the maximum height of said uppermost portion of said longitudinally extending rear portion.

2. A cutter in accordance with claim 1 in which said downwardly extending cutting edge portion extends forwardly of the uppermost region of said upwardly extending cutting edge portion a distance equal to approximately one-third the front to rear length dimension of said upwardly extending cutting edge portion.

3. A blade in accordance with claim 1 in which said convexly curved front tip portion has a height approximately one-quarter of the maximum height of the upwardly extending cutting edge portion.

* * * * *